US010216127B2

(12) United States Patent
Yokoyama

(10) Patent No.: US 10,216,127 B2
(45) Date of Patent: Feb. 26, 2019

(54) FIXING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shuji Yokoyama, Nagaizumi Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/908,876

(22) Filed: Mar. 1, 2018

(65) Prior Publication Data

US 2018/0188674 A1 Jul. 5, 2018

Related U.S. Application Data

(63) Continuation of application No. 15/219,547, filed on Jul. 26, 2016.

(30) Foreign Application Priority Data

Nov. 17, 2015 (JP) ..... 2015-225039

(51) Int. Cl.
*G03G 15/20* (2006.01)

(52) U.S. Cl.
CPC ..... *G03G 15/2039* (2013.01); *G03G 15/205* (2013.01); *G03G 15/2053* (2013.01)

(58) Field of Classification Search
CPC ..... G03G 15/2039; G03G 15/205; G03G 15/2053; G03G 2215/2025
See application file for complete search history.

(56) References Cited

U.S. PATENT DOCUMENTS 7,006,781 B2 * 2/2006 Imai ..... G03G 15/2053 219/216
9,335,682 B2 5/2016 Kurokawa
2008/0124147 A1 5/2008 Uehara et al.
(Continued)

FOREIGN PATENT DOCUMENTS

JP 2004-170659 6/2004
JP 2005-092020 4/2005
JP 2014-013352 1/2014

OTHER PUBLICATIONS

Extended European Search Report for European Patent Application No. 16198097.4 dated Mar. 16, 2017.
(Continued)

*Primary Examiner* — Erika J Villaluna
(74) *Attorney, Agent, or Firm* — Amin, Turocy & Watson LLP

(57) ABSTRACT

In accordance with an embodiment, a fixing apparatus comprises a belt which is equipped with a conductive layer; an induction current generator which faces the belt and heats the conductive layer through an electromagnetic induction system; a magnetic material which faces the induction current generator across the belt; a measurement section which measures a state of the magnetic material; and a controller which controls a frequency applied to the induction current generator based on a measurement result of the measurement section in a case in which at least a print request is not received.

14 Claims, 8 Drawing Sheets

(56) References Cited

U.S. PATENT DOCUMENTS

| | | | |
|---|---|---|---|
| 2012/0148287 | A1 | 6/2012 | Samei et al. |
| 2013/0148995 | A1 | 6/2013 | Yoshikawa et al. |
| 2014/0314456 | A1 | 10/2014 | Kikuchi |

OTHER PUBLICATIONS

Non-Final Office Action for U.S. Appl. No. 15/219,547 dated Jan. 12, 2017.
Final Office Action for U.S. Appl. No. 15/219,547 dated Aug. 11, 2017.

* cited by examiner

FIXING APPARATUS

CROSS-REFERENCE TO RELATED APPLICATIONS

This application is a Continuation of application Ser. No. 15/219,547 filed on Jul. 26, 2016, the entire contents of which are incorporated herein by reference.

This application is based upon and claims the benefit of priority from Japanese Patent Application No. 2015-225039, filed Nov. 17, 2015, the entire contents of which are incorporated herein by reference.

FIELD

Embodiments described herein relate generally to a fixing apparatus.

BACKGROUND

Conventionally, there is an image forming apparatus such as a multi-function peripheral (hereinafter, referred to as an "MFP") and a printer. The image forming apparatus is equipped with a fixing apparatus. The fixing apparatus heats a conductive layer of a belt with an electromagnetic induction heating system (hereinafter, referred to as an "IH system"). The fixing apparatus fixes a toner image on an image receiving medium through the heat of the belt. The conductive layer of the belt generates heat via application of an induction current. In order to shorten the warming-up time, the fixing apparatus reduces the heat capacity of the belt. In order to replenish insufficient calorific value of the belt, the fixing apparatus is equipped with a magnetic material. The magnetic material enables a magnetic flux generated at the time of the electromagnetic induction heating to be concentrated in order to increase the calorific value of the belt. For example, the magnetic material is a magnetic shunt alloy.

Generally, the fixing apparatus keeps the belt at a preset fixing temperature to maintain a fixable state at the time of forming an image. At least in a standby state in which no print request is received, in order to save electric power, the fixing apparatus keeps the belt at a standby temperature lower than the fixing temperature. The standby temperature is set in a range from a temperature at the time of non-heating to the fixing temperature. The standby temperature is set to a temperature at which the belt can be rapidly heated to the fixing temperature when the fixing apparatus changes from the standby state to a fixing operation. The heating of the belt is adjusted by an electric power control. In the standby state, in order to keep the temperature of the belt (hereinafter, referred to as "belt temperature") constant, an induction current generation section is controlled to make output of the induction current constant.

Incidentally, in the standby state, an initial value of a frequency applied to the induction current generation section is determined by a target value of an output (hereinafter, referred to as "IH output") of the induction current generation section. Ina case in which the magnetic material is the magnetic shunt alloy, magnetism of the magnetic material sharply changes from ferromagnetism to paramagnetism if the temperature thereof exceeds a Curie point thereof. In a case in which the magnetic material is the magnetic shunt alloy, the magnetism of the magnetic material slowly changes from the ferromagnetism to the paramagnetism if the temperature thereof becomes high despite not exceeding the Curie point thereof. If the magnetism of the magnetic material changes, a load (hereinafter, referred to as an "IH load") of the induction current generation section also changes. Through the change of the IH load, a proper initial value of a frequency changes. If the proper initial value of the frequency cannot be set, the IH output is deviated from the target value, and it is difficult to keep the belt temperature constant in the standby state. For example, if the IH output is excessively high, the belt temperature is excessively increased in the standby state, and thus there is a possibility that the belt is damaged. On the other hand, if the IH output is excessively low, the belt temperature cannot be sufficiently increased in the standby state, and there is a possibility that the belt cannot be kept at a proper standby temperature.

DETAILED DESCRIPTION

In accordance with an embodiment, a fixing apparatus includes a belt, an induction current generator, a magnetic material, a measurement section, a controller. The belt is equipped with a conductive layer. The induction current generator faces the belt. The induction current generator heats the conductive layer through an electromagnetic induction system. The magnetic material faces the induction current generator across the belt. The measurement section measures a state of the magnetic material. In a case in which at least a print request is not received, the controller controls a frequency applied to the induction current generator based on the measurement result of the measurement section.

In accordance with another embodiment, a fixing method involves heating a conductive layer of a belt using electromagnetic induction, a magnetic material configured to face the electromagnetic induction across the belt; measuring a state of the magnetic material; and controlling a frequency applied to generate the electromagnetic induction based on a measurement result of measuring the state of the magnetic material in a case in which at least a print request is not received.

First Embodiment

Hereinafter, an image forming apparatus 10 of the first embodiment is described with reference to the accompanying drawings. Further, in each figure, the same components are assigned with the same marks.

Figure 1:
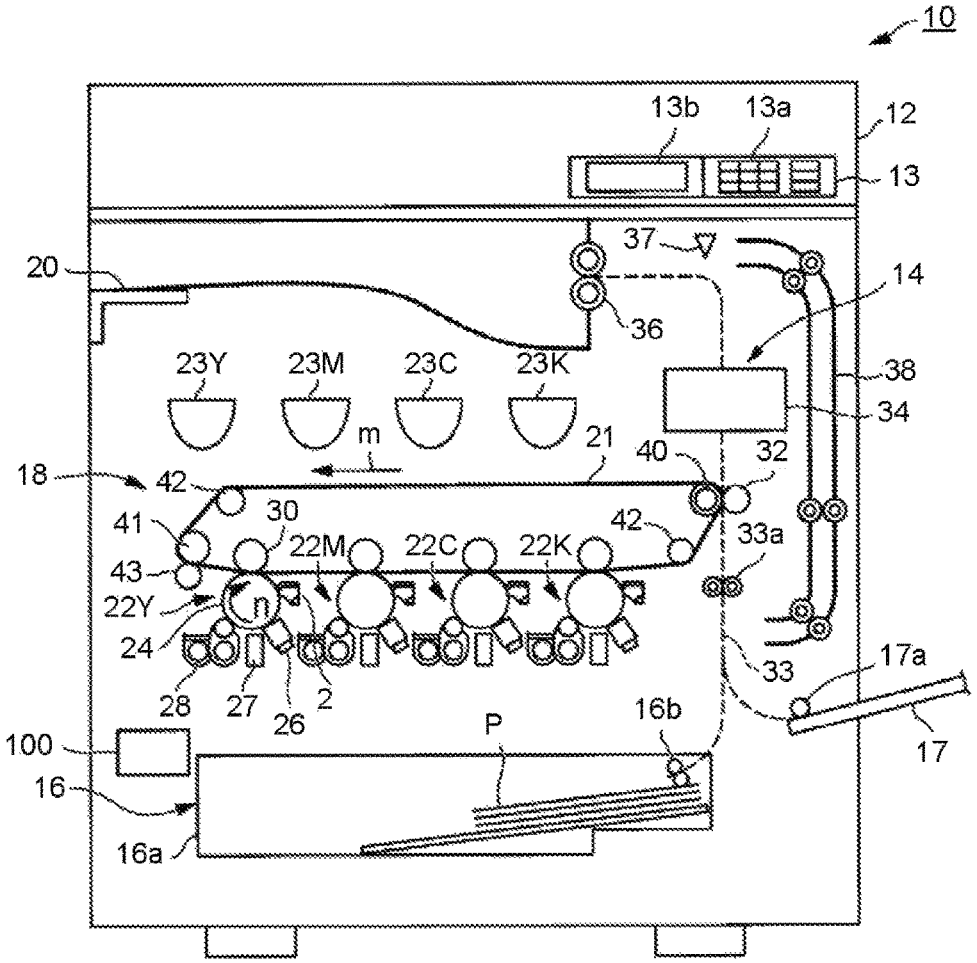
FIG. 1 is a side view of an image forming apparatus according to a first embodiment.

FIG. 1 is a side view of the image forming apparatus 10 according to the first embodiment. Hereinafter, an MFP 10 is described as an example of the image forming apparatus 10.

As shown in FIG. 1, the MFP 10 is equipped with a scanner 12, a control panel 13 and a main body section 14. The scanner 12, the control panel 13 and the main body section 14 are respectively equipped with a controller or control section. The MFP 10 is equipped with a system control section 100 for collectively controlling the control sections. The system control section 100 (or system controller) is equipped with a CPU (Central Processing Unit) 100*a*, a ROM (Read Only Memory) 100*b* and a RAM (Random Access Memory) 100*c* (refer to FIG. 4).

The system control section 100 controls a main body control circuit 101 (refer to FIG. 2) serving as a control section of the main body section 14. The main body control circuit 101 is equipped with a CPU, a ROM and a RAM (none is shown). The main body section 14 is equipped with a sheet feed cassette section 16, a printer section 18 (or printer) and a fixing apparatus 34. The main body control circuit 101 controls the sheet feed cassette section 16, the printer section 18 and the fixing apparatus 34.

The scanner 12 reads a document image. The control panel 13 is equipped with an input key 13*a* and a display section 13*b*. For example, the input key 13*a* receives an input of a user. For example, the display section 13*b* is a touch panel type. The display section 13*b* receives the input by the user to display it to the user.

The sheet feed cassette section 16 is equipped with a sheet feed cassette 16*a* and a pickup roller 16*b*. The sheet feed cassette 16*a* houses a sheet P serving as an image receiving medium. The pickup roller 16*b* takes out the sheet P from the sheet feed cassette 16*a*.

The sheet feed cassette 16*a* feeds an unused sheet P. The sheet feed tray 17 feeds an unused sheet P through a pickup roller 17*a*.

The printer section 18 is used to form an image. For example, the printer section 18 forms an image of the document image read by the scanner 12. The printer section 18 is equipped with an intermediate transfer belt 21. The printer section 18 supports the intermediate transfer belt 21 with a backup roller 40, a driven roller 41 and a tension roller 42. The backup roller 40 is equipped with a driving section (not shown). The printer section 18 rotates the intermediate transfer belt 21 in an arrow m direction.

The printer section 18 is equipped with four groups of image forming stations including the image forming stations 22Y, 22M, 22C and 22K. The image forming stations 22Y, 22M, 22C and 22K are respectively used to form a Y (yellow) image, an M (magenta) image, a C (cyan) image and a K (black) image. The image forming stations 22Y, 22M, 22C and 22K, located at the lower side of the intermediate transfer belt 21, are arranged in parallel along the rotation direction of the intermediate transfer belt 21. The printer can contain fewer or more than four image forming stations.

The printer section 18 is equipped with cartridges 23Y, 23M, 23C and 23K above the image forming stations 22Y, 22M, 22C and 22K correspondingly. The cartridges 23Y, 23M, 23C and 23K are used to house Y (yellow) toner, M (magenta) tone, C (cyan) tone and K (black) tone for replenishment.

Hereinafter, among the image forming stations 22Y, 22M, 22C and 22K, the image forming station 22Y of Y (yellow) is described as an example. Further, as the image forming stations 22M, 22C and 22K have the same configuration as the image forming station 22Y, the detailed description thereof is omitted.

The image forming station 22Y is equipped with a charging charger 26, an exposure scanning head 27, a developing device 28 and a photoconductor cleaner 29. The charging charger 26, the exposure scanning head 27, the developing device 28 and the photoconductor cleaner 29 are arranged around a photoconductive drum 24 which rotates in the arrow n direction.

The image forming station 22Y is equipped with a primary transfer roller 30. The primary transfer roller 30 faces the photoconductive drum 24 across the intermediate transfer belt 21.

After charging the photoconductive drum 24 with the charging charger 26, the image forming station 22Y exposes the photoconductive drum 24 with the exposure scanning head 27. The image forming station 22Y forms an electrostatic latent image on the photoconductive drum 24. The developing device 28 develops the electrostatic latent image on the photoconductive drum 24 with a two-component developing agent formed by toner and a carrier.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 with the primary transfer roller 30. The color toner image is formed by overlapping the Y (yellow) toner image, the M (magenta) toner image, the C (cyan) toner image and the K (black) toner image in order. The photoconductor cleaner 29 removes the toner left on the photoconductive drum 24 after the primary transfer.

The printer section 18 is equipped with a secondary transfer roller 32. The secondary transfer roller 32 faces a backup roller 40 across the intermediate transfer belt 21. The secondary transfer roller 32 secondarily transfers the color toner image on the intermediate transfer belt 21 collectively onto a sheet P. The sheet P is fed from a sheet feed cassette section 16 or a manual sheet feed tray 17 along a conveyance path 33.

The printer section 18 is equipped with a belt cleaner 43 facing the driven roller 41 across the intermediate transfer belt 21. The belt cleaner 43 is used to remove the toner left on the intermediate transfer belt 21 after the secondary transfer.

The printer section 18 is equipped with a resist roller 33*a*, the fixing apparatus 34 and a sheet discharging roller 36 along the conveyance path 33. The printer section 18 is equipped with a bifurcating section 37 and a reverse conveyance section 38 at the downstream side of the fixing apparatus 34. The bifurcating section 37 sends the sheet P after a fixing processing to a discharging section 20 or the reverse conveyance section 38. In a case of duplex printing, a reverse conveyance section 38 reverses the sheet P sent from the bifurcating section 37 to the direction of the resist roller 33*a* to convey the sheet P. The MFP 10 forms a fixed toner image on the sheet P with the printer section 18 to discharge the sheet P to the discharging section 20.

Further, the MFP 10 is not limited to a tandem developing method, and the number of the developing devices 28 is also not limited. Further, the MFP 10 may directly transfer the toner image from the photoconductive drum 24 onto the sheet P.

Hereinafter, the fixing apparatus 34 is described in detail.

Figure 2:
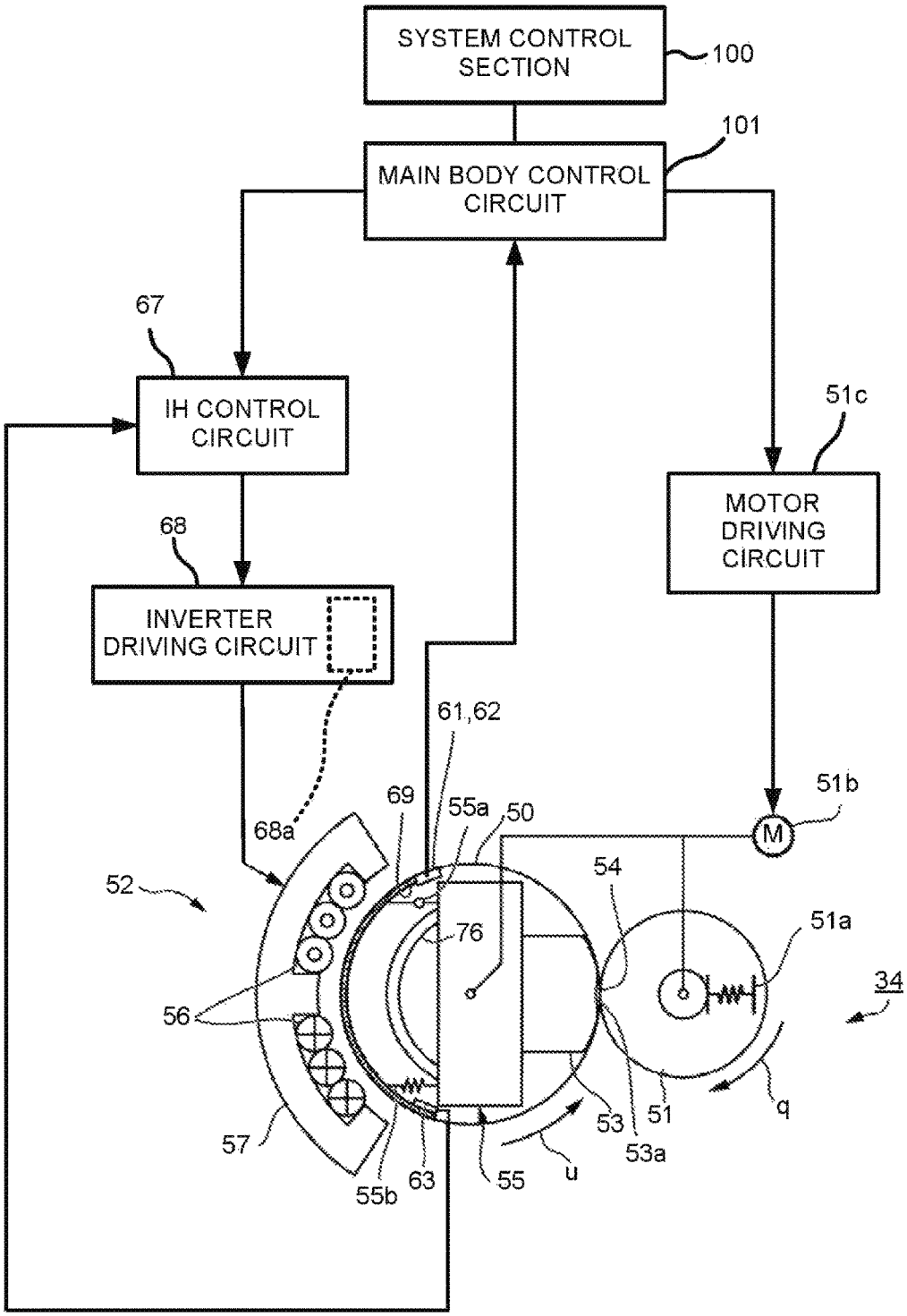
FIG. 2 is a side view containing a control block of an IH coil unit according to the first embodiment.

FIG. 2 is a side view containing control blocks of an electromagnetic induction heating coil unit 52 (induction current generation section) and the main body control circuit 101 (control section) according to the first embodiment. Hereinafter, the electromagnetic induction heating coil unit is referred to as an "IH coil unit".

As shown in FIG. 2, the fixing apparatus 34 is equipped with a belt 50, a press roller 51, an IH coil unit 52, an auxiliary heat generation plate 69 (magnetic material) and the main body control circuit 101.

The belt 50 is a cylindrical endless belt. In the inner peripheral side of the belt 50, a belt inside mechanism 55 containing a nip pad 53 and the auxiliary heat generation plate 69 is arranged. In the present embodiment, the belt 50 and the auxiliary heat generation plate 69 contact with each other.

The belt 50 is formed by overlapping a heat generation layer 50*a* (conductive layer) serving as a heat generation section and a releasing layer 50*c* on a base layer 50*b* (refer to FIG. 3) sequentially. Further, the layer structure of the belt 50 may be optional as long as the belt 50 is equipped with the heat generation layer 50*a*.

For example, the base layer 50*b* is formed by polyimide resin (PI). For example, the heat generation layer 50*a* is formed by a nonmagnetic metal such as copper (Cu). For example, the releasing layer 50*c* is formed by fluororesin such as tetrafluoroethylene-perfluoroalkyl vinyl ether copolymer resin (PFA) or the like.

The belt 50 makes the heat generation layer 50*a* thin to reduce the heat capacity in order to rapidly be warmed up. The belt 50 of which the heat capacity is reduced can shorten the time required for warming-up to save the consumption energy.

For example, in order to reduce the heat capacity, the thickness of the copper layer of the heat generation layer 50*a* of the belt 50 is set to 10 μm. For example, the heat generation layer 50*a* is covered by a protective layer such as nickel. The protective layer such as nickel inhibits the oxidation of the copper layer. The protective layer such as nickel improves mechanical strength of the belt 50.

Further, the heat generation layer 50*a* may be formed by being subjected to an electroless nickel plating together with a copper plating on the base layer 50*b* formed by polyimide resin. Through being subjected to the electroless nickel plating, adhesion strength between the base layer 50*b* and the heat generation layer 50*a* is improved. Through being subjected to the electroless nickel plating, the mechanical strength of the belt 50 is improved.

Further, the surface of the base layer 50*b* may be rough by sandblasting or chemical etching. Through roughing the surface of the base layer 50*b*, the adhesion strength between the base layer 50*b* and the nickel plating layer of the heat generation layer 50*a* is further mechanically improved.

Further, metal such as titanium (Ti) may be dispersed in polyimide resin forming the base layer 50*b*. Through dispersing the metal in the base layer 50*b*, the adhesion strength between the base layer 50*b* and the nickel plating layer of the heat generation layer 50*a* is further improved.

For example, the heat generation layer 50*a* may be formed by nickel, iron (Fe), stainless steel, aluminum (Al) and silver (Ag), etc. The heat generation layer 50*a* may be formed by using two or more kinds of alloys, or formed by overlapping two or more kinds of metal in a layered manner.

As shown in FIG. 2, the IH coil unit 52 is equipped with amain coil 56. A high frequency current is applied to the main coil 56 from an inverter driving circuit 68. Through enabling the high frequency current to flow in the main coil 56, a high frequency magnetic field is generated around the main coil 56. Through the magnetic flux of the high frequency magnetic field, an eddy current is generated in the heat generation layer 50*a* of the belt 50. Through the electric resistance of the eddy current and the heat generation layer 50*a*, Joule heat is generated in the heat generation layer 50*a*. Through the generation of the Joule heat, the belt 50 is heated.

The auxiliary heat generation plate 69 is arranged at the inner peripheral side of the belt 50. When viewed from a width direction (hereinafter, referred to as "a belt width direction") of the belt 50, the auxiliary heat generation plate 69 is formed into an arc shape along the inner peripheral surface of the belt 50. The auxiliary heat generation plate 69 faces the main coil 56 across the belt 50. The auxiliary heat generation plate 69 is a magnetic shunt alloy (ferromagnetism body) of which the Curie point is lower than that of the heat generation layer 50*a*. Through the magnetic flux generated by the main coil 56, magnetic flux is generated between the auxiliary heat generation plate 69 and the belt 50. Through the generation of the magnetic flux, the belt 50 is heated.

Two arc-shaped ends (upper end and lower end) of the auxiliary heat generation plate 69 are supported by a foundation (not shown). For example, the upper end of the auxiliary heat generation plate 69 is supported by a pivot shaft 55*a* along the belt width direction. The lower end of the auxiliary heat generation plate 69 is elastically supported by an elastic member 55*b* such as a spring. The auxiliary heat generation plate 69 is pressed towards the belt 50. A lateral surface of the auxiliary heat generation plate 69 in a radial direction contacts the inner peripheral surface of the belt 50.

Further, through the belt inside mechanism 55, the auxiliary heat generation plate 69 may be close to/away from the belt 50. For example, the belt inside mechanism 55 may enable the lateral surface of the auxiliary heat generation plate 69 in the radial direction to separate from the inner peripheral surface of the belt 50 at the time of warming up the fixing apparatus 34.

For example, the length of the auxiliary heat generation plate 69 in the belt width direction is greater than the length (hereinafter, referred to as "a sheet width") of a sheet passing area in the belt width direction. Further, the sheet width is the width of a sheet of which the short side is the largest among the used sheets. For example, the sheet width is set to a width a little larger than the short side width of an A3 sheet.

Figure 3:
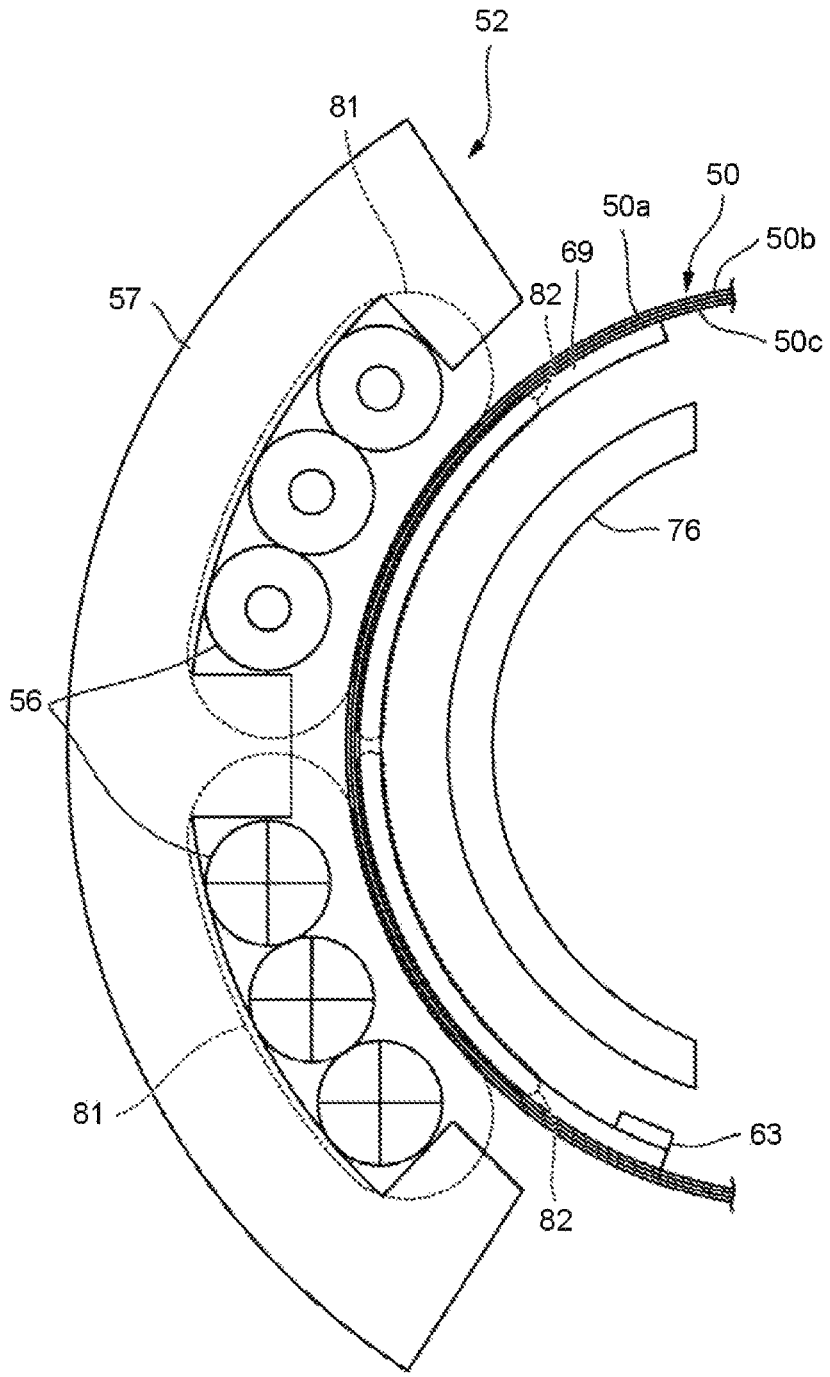
FIG. 3 is a view illustrating magnetic circuits to a belt and an auxiliary heat generation plate of magnetic flux of the IH coil unit according to the first embodiment.

FIG. 3 is a view illustrating the magnetic circuits to the belt 50 and the auxiliary heat generation plate 69 by the magnetic flux of the main coil 56 according to the first embodiment.

As shown in FIG. 3, the magnetic flux generated by the main coil 56 forms a first magnetic circuit 81 induced to the heat generation layer 50*a* of the belt 50. The first magnetic circuit 81 passes through a core 57 of the main coil 56 and the heat generation layer 50*a* of the belt 50. The magnetic flux generated by the main coil 56 forms a second magnetic circuit 82 induced to the auxiliary heat generation plate 69. The second magnetic circuit 82 is formed at a position adjacent to the first magnetic circuit 81 in the radial direction (hereinafter, referred to as "belt radial direction") of the belt 50. The second magnetic circuit 82 passes through the auxiliary heat generation plate 69 and the heat generation layer 50*a*.

The auxiliary heat generation plate 69 is made from a member of which the Curie point is lower than that of the heat generation layer 50*a* of the belt 50. For example, the auxiliary heat generation plate 69 is formed by a thin metal member made from the magnetic shunt alloy such as iron or nickel alloy the Curie point of which is 220° C.~230° C. The magnetism of the auxiliary heat generation plate 69 changes from the ferromagnetism to the paramagnetism if the temperature exceeds the Curie point thereof. If the temperature of the auxiliary heat generation plate 69 exceeds the Curie point, the second magnetic circuit 82 is not formed, thereby not assisting the heating of the belt 50. Through forming the auxiliary heat generation plate 69 with the magnetic shunt alloy, by taking the Curie point as a boundary, the auxiliary heat generation plate 69 can assist to raise the temperature of the belt 50 at the time of a low temperature and to suppress excessive rise of the temperature of the belt 50 at the time of a high temperature.

Further, the auxiliary heat generation plate 69 may be formed by a thin metal member such as iron, nickel, stainless and the like which is equipped with a magnetism characteristic. The auxiliary heat generation plate 69 may be formed by resin containing magnetism powder as long as it has the magnetism characteristic. The auxiliary heat generation plate 69 may also be formed by a magnetic material (ferrite). The member forming the auxiliary heat generation plate 69 is not limited to a thin plate member.

As shown in FIG. 2, a shield 76 is arranged at the inner peripheral side of the auxiliary heat generation plate 69. The shield 76 is formed into the same arc shape as the auxiliary heat generation plate 69. Two arc-shaped ends of the shield 76 are supported by a foundation (not shown). The shield 76 may support the auxiliary heat generation plate 69. For example, the shield 76 is formed by a non-magnetic material such as aluminum and copper. The shield 76 shields the magnetic flux from the IH coil unit 52.

At the inner peripheral side of the belt 50, the nip pad 53 presses the inner peripheral surface of the belt 50 to the press roller 51. A nip 54 is formed between the belt 50 and the press roller 51. The nip pad 53 has a nip forming surface 53*a* between the belt 50 and the press roller 51. When viewed from the belt width direction, the nip forming surface 53*a* curves to form a convex on the inner peripheral side of the belt 50. When viewed from the belt width direction, the nip forming surface 53*a* curves along the outer peripheral surface of the press roller 51.

For example, the nip pad 53 is formed by elastic materials such as silicon rubber and fluorine rubber. The nip pad 53 is formed by heat-resistant resin such as polyimide resin (PI), polyphenylene sulfide resin (PPS), polyether sulphone resin (PES), liquid crystal polymer (LCP) and phenol resin (PF) and the like.

For example, a sheet-like friction reducing member is arranged between the belt 50 and the nip pad 53. For example, the friction reducing member is formed by a sheet member and the releasing layer having excellent sliding property and good wear resistance. The friction reducing member is fixedly supported by the belt inside mechanism 55. The friction reducing member slidably contacts the inner peripheral surface of the belt 50 that is operating. The friction reducing member may be formed by the following sheet member with lubricity. For example, the sheet member may be composed of glass fiber sheet impregnated with fluororesin.

For example, the press roller 51 is equipped with a silicone sponge and a silicone rubber layer having heat-resistance around a core metal thereof. For example, a releasing layer is arranged on the surface of the press roller 51. The releasing layer is formed by the fluorine-based resin such as PFA resin. The press roller 51 pressurizes the belt 50 by a pressure mechanism 51*a*.

As a driving source of the belt 50 and the press roller 51, one motor 51*b* (driving section) is arranged. The motor 51*b* is driven by a motor driving circuit 51*c* controlled by the main body control circuit 101. The motor 51*b* is connected with the press roller 51 via a first gear row (not shown). The motor 51*b* is connected with a belt driving member via a second gear row and a one-way clutch (none is not shown). The press roller 51 rotates in an arrow q direction through the motor 51*b*. At the time the belt 50 abuts against the press roller 51, the belt 50 is driven by the press roller 51 to rotate in an arrow u direction. At the time of the separation of the belt 50 and the press roller 51, the belt 50 rotates in an arrow u direction through the motor 51*b*. Further, the belt 50 may be separated from the press roller 51 and have a driving source thereof.

At the inner peripheral side of the belt 50, a center thermistor 61 and an edge thermistor 62 (temperature measurement sections) are arranged. The center thermistor 61 and the edge thermistor 62 are used to measure the belt temperature. The measurement result of the belt temperature is input to the main body control circuit 101. The center thermistor 61 is arranged at the inner side of the belt width direction. The edge thermistor 62 is arranged in the heating area of the IH coil unit 52 and the sheet non-passing area in the belt width direction. The main body control circuit 101 stops the output of the electromagnetic induction heating when the belt temperature measured by the edge thermistor 62 is equal to or greater than a threshold value. By stopping the output of the electromagnetic induction heating when the temperature of the sheet non-passing area of the belt 50 excessively rises, the damage of the belt 50 is prevented.

The main body control circuit 101 controls an IH control circuit 67 according to the measurement result of the belt temperature by the center thermistor 61 and the edge thermistor 62. The IH control circuit 67 controls the value of the high frequency current output by the inverter driving circuit 68 under the control of the main body control circuit 101. The temperature of the belt 50 is maintained in various control temperature ranges according to the output by the inverter driving circuit 68. The IH control circuit 67 is equipped with a CPU, a ROM and a RAM (none is shown).

For example, a thermostat 63 is arranged in the belt inside mechanism 55. The thermostat 63 functions as a safety device of the fixing apparatus 34. The thermostat 63 operates when the belt 50 generates abnormal heat and the temperature thereof rises to a cut-off threshold value. Through the operation of the thermostat 63, the current to the IH coil unit 52 is cut off. Through cutting off the current to the IH coil unit 52, the abnormal heat generation of the fixing apparatus 34 can be prevented.

Figure 4:
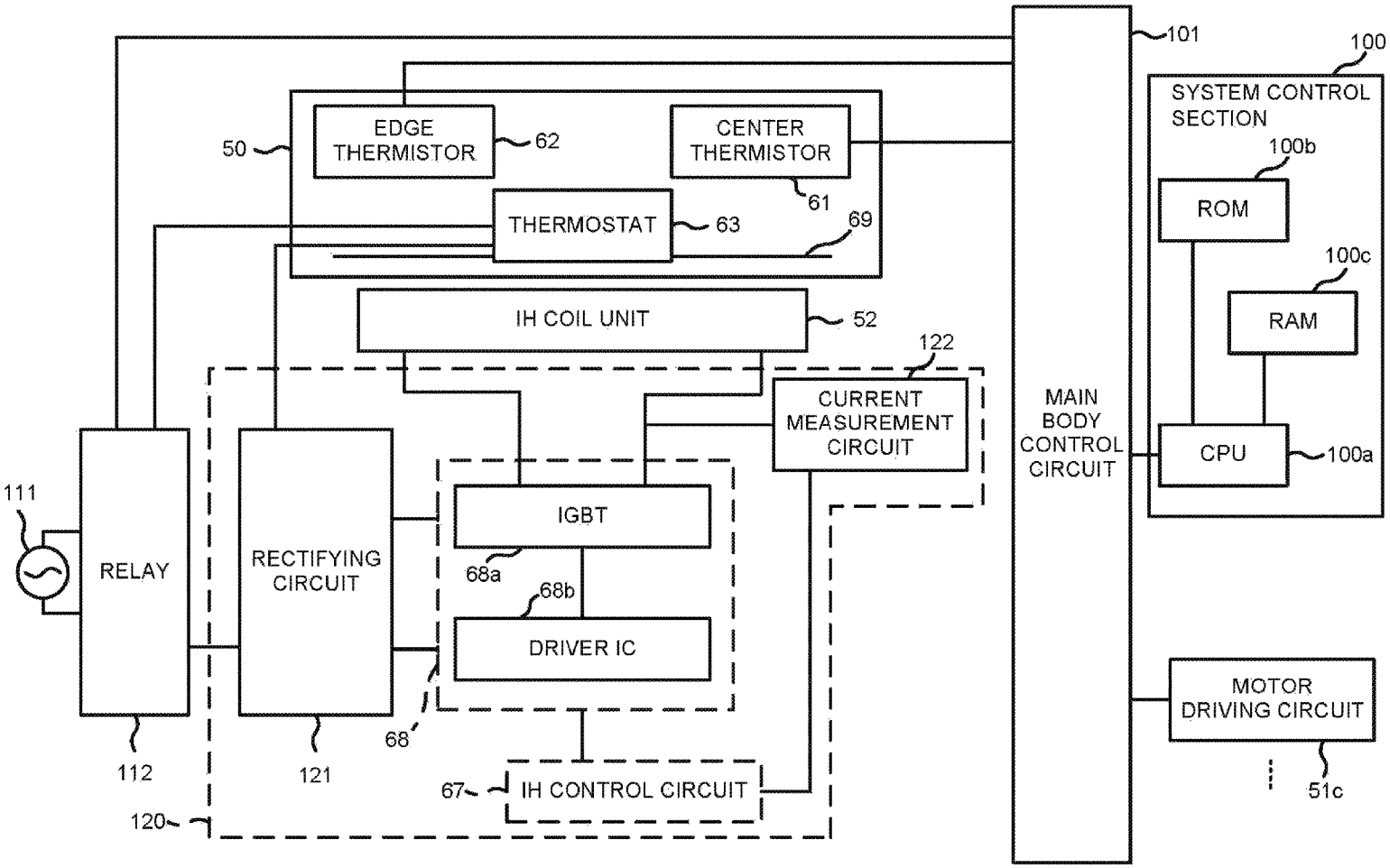
FIG. 4 is a block diagram illustrating a control circuit of the IH coil unit according to the first embodiment.

FIG. 4 is a block diagram illustrating the control of the IH coil unit 52 according to the first embodiment as a main body.

As shown in FIG. 4, the MFP 10 (refer to FIG. 1) is equipped with the system control section 100, the main body control circuit 101, an IH circuit 120 and the motor driving circuit 51*c*. The IH circuit 120 is equipped with a rectifying circuit 121, an IH control circuit 67, the inverter driving circuit 68 and a current measurement circuit 122.

The current is input to the IH circuit 120 via a relay 112 from an alternating-current power supply 111. The IH circuit 120 rectifies the input current through the rectifying circuit 121 to supply the rectified current to the inverter driving circuit 68. In a case in which the thermostat 63 is cut off, the relay 112 cuts off the current from the alternating-current power supply 111. The inverter driving circuit 68 is equipped with a driver IC 68*b* of an ICBT (Insulated Gate Bipolar Transistor) element 68*a*. The IH control circuit 67 controls the driver IC 68*b* according to the measurement result of the belt temperature by the center thermistor 61 and the edge thermistor 62. The IH control circuit 67 controls the driver IC 68*b* to control the output of the ICBT element 68*a*. The current measurement circuit 122 sends the measurement result of the output of the ICBT element 68*a* to the IH control circuit 67. The IH control circuit 67 controls the driver IC 68*b* to make the output of the IH coil unit 52 constant based on the measurement result of the output of the ICBT element 68*a* by the current measurement circuit 122.

The main body control circuit 101 acquires the belt temperature from the center thermistor 61 and the edge thermistor 62. In the present embodiment, as the belt 50 contacts the auxiliary heat generation plate 69, the belt temperature of the belt 50 is substantially the same as that of the auxiliary heat generation plate 69. Thus, through acquiring the belt temperature, the temperature of the auxiliary heat generation plate 69 can also be indirectly acquired. In the standby state, the main body control circuit 101 controls the frequency applied to the IH coil unit 52 based on the belt temperature to enable the IH output to approach to the target value.

Further, "the standby state" refers to a standby state in which the fixing apparatus 34 does not execute the fixing operation and is equivalent to a state in which the MFP 10 (refer to FIG. 1) does not receive the print request.

Herein, there is a correlation among the temperature of the auxiliary heat generation plate 69, the IH output and the frequency applied to the IH coil unit 52. Hereinafter, an example of the correlation is described.

The higher the temperature of the auxiliary heat generation plate 69 is, the lower the IH output becomes. On the other hand, the lower the frequency applied to the IH coil unit 52 is, the higher the IH output becomes.

For example, the ROM of the main body control circuit 101 stores a table at the time of determining the frequency applied to the IH coil unit 52 based on the temperature of the auxiliary heat generation plate 69.

Figure 5:
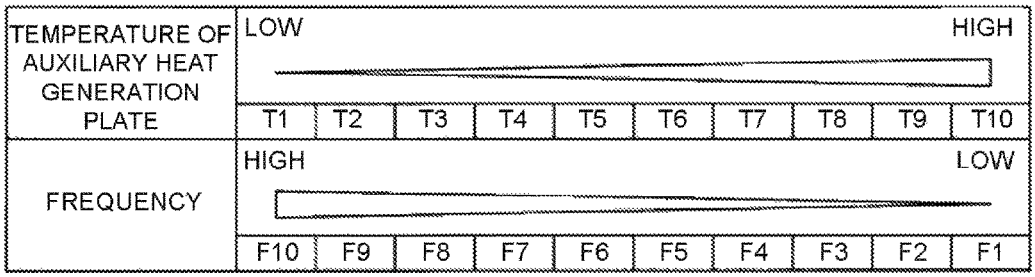
FIG. 5 is a diagram illustrating an example of a table at the time of determining a frequency applied to the IH coil unit based on a temperature of the auxiliary heat generation plate according to the first embodiment.

FIG. 5 is a diagram illustrating an example of the table at the time of determining the frequency applied to the IH coil unit 52 based on the temperature of the auxiliary heat generation plate 69.

In FIG. 5, the temperature of the auxiliary heat generation plate 69 is set within a range of T1~T10. T1 refers to a relatively low temperature, and T10 refers to a relatively high temperature. The closer the temperature is to T10 side, the higher the temperature is.

The frequency is set within a range of F1~F10. F1 refers to a relatively low frequency, and F10 refers to a relatively high frequency. The closer the frequency is to F10 side, the higher the frequency is.

The main body control circuit 101 carries out IH control based on the table. For example, as the higher the temperature of the auxiliary heat generation plate 69 is, the lower the IH output becomes, the following control is carried out. As shown in FIG. 5, the main body control circuit 101 carries out the IH control in such a manner that the higher the temperature of the auxiliary heat generation plate 69 is, the lower the frequency applied to the IH coil unit 52 becomes. Through executing the IH control based on the table, the IH output can be close to the target value. Through enabling the IH output to approach to the target value, the belt 50 can be kept at the proper standby temperature.

Further, the ROM of the main body control circuit 101 stores information indicating how much the belt 50 rotates at the time of enabling the belt 50 to rotate for a certain period of time from a stopped state in the standby state. In the present embodiment, the ROM of the main body control circuit 101 stores rotation time of the belt 50. For example, the rotation time of the belt 50 refers to a time when the belt 50 can rotate by 180 degrees.

Hereinafter, an example of an operation (hereinafter, referred to as "the standby job") of the fixing apparatus 34 in the standby state according to the first embodiment is described.

Figure 6:
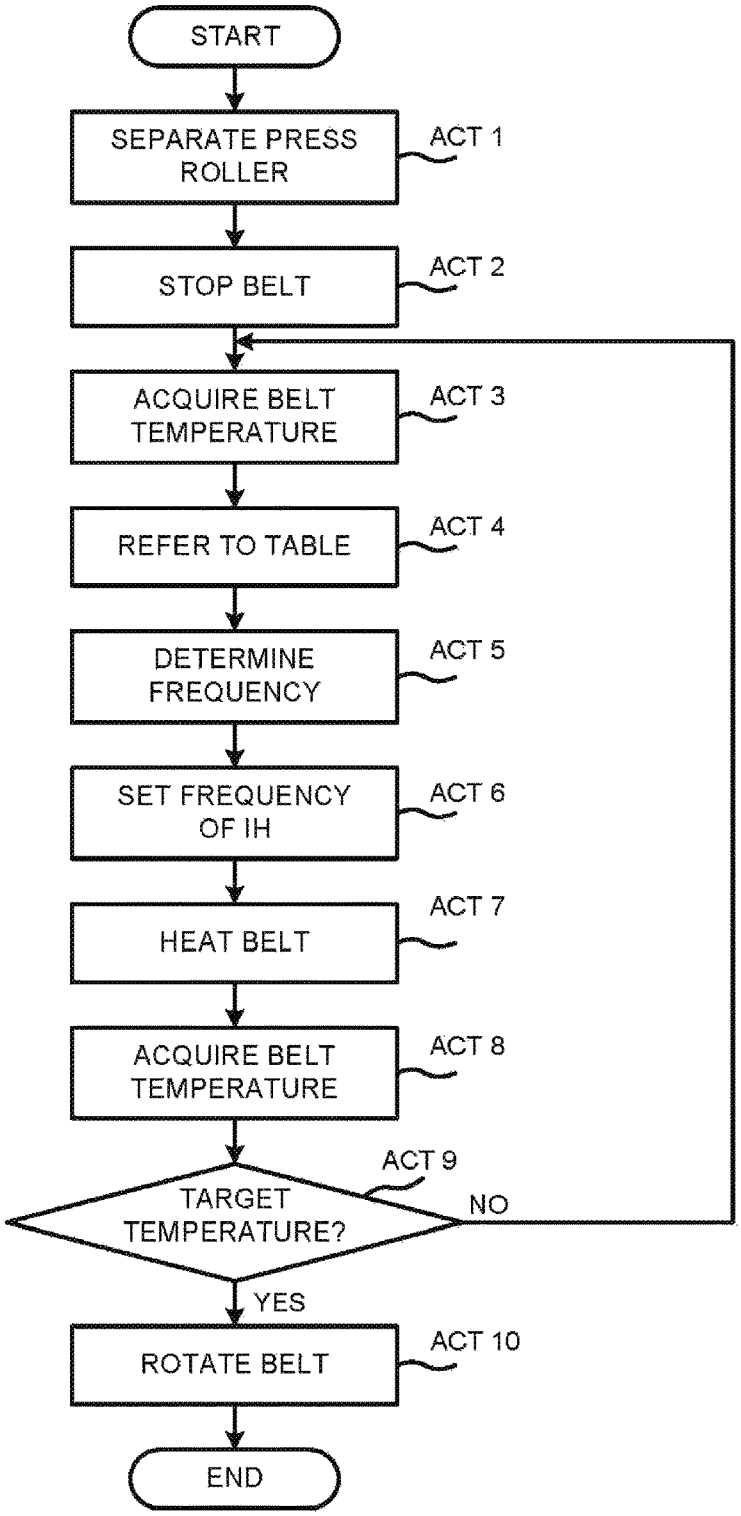
FIG. 6 is a flowchart illustrating an example of a standby job according to the first embodiment.

FIG. 6 is a flowchart illustrating an example of the standby job according to the first embodiment. Further, in a case in which the MFP 10 receives the print request, the MFP 10 immediately terminates the standby job to start the printing. At the time the standby job of the present embodiment is started, it is assumed that the belt temperature does not reach the target temperature.

In Act 1, the main body control circuit 101 carries out the control to enable the press roller 51 to separate from the belt 50. Supposedly, if the press roller 51 is continuously pressed towards the belt 50 in the standby state, there is a possibility that creep deformation of the belt 50 occurs. In the present embodiment, in the standby state, through enabling the press roller 51 to separate from the belt 50, the creep deformation of the belt 50 can be avoided.

In Act 2, the main body control circuit 101 carries out the control so as to stop the belt 50.

In Act 3, the main body control circuit 101 acquires the belt temperature from the center thermistor 61 and the edge thermistor 62. As the belt 50 contacts the auxiliary heat generation plate 69 in the present embodiment, through acquiring the belt temperature, the temperature of the auxiliary heat generation plate 69 can be estimated.

In the present embodiment, the main body control circuit 101 controls the frequency applied to the IH coil unit 52 based on the belt temperature.

With the following reasons, the control by the main body control circuit 101 based on the belt temperature is carried out.

In the standby state, an initial value of the frequency applied to the IH coil unit 52 is determined by the target value of the IH output. In a case in which the auxiliary heat generation plate 69 is formed by the magnetic shunt alloy, the IH load changes depending on the change of the magnetism of the auxiliary heat generation plate 69. Due to the change of the IH load, the proper initial value of the frequency also changes. For example, in a case in which the auxiliary heat generation plate 69 is at a normal temperature, the IH output becomes the output with 300 W at a frequency of 98 kHz. On the other hand, in a case in which the temperature of the auxiliary heat generation plate 69 exceeds the Curie point thereof, by reducing the IH load, the IH output becomes the output of 200 W at the frequency of 98 kHz. Thus, if the temperature of the auxiliary heat generation plate 69 in the standby state is known, the frequency applied to the IH coil unit 52 can be controlled matching the target value of the IH output.

In Act 4-Act 7, the main body control circuit 101 carries out the IH control based on the table (refer to FIG. 5).

In Act 4, the main body control circuit 101 refers to the table.

In Act 5, based on the belt temperature (temperature of the auxiliary heat generation plate 69), the frequency applied to the IH coil unit 52 is determined.

In Act 6, the determined frequency is set as the frequency applied to the IH coil unit 52. In the present embodiment, as the frequency is determined based on the table, the proper initial value of the frequency can be set.

In Act 7, the set frequency is applied to the IH coil unit 52 to heat the belt 50.

Further, in Act 7, the main body control circuit 101 may control stop time of the belt 50. In the standby state, by controlling the stop time of the belt 50, the excessive rise of the belt temperature can be suppressed. For example, the main body control circuit 101 carries out the control so as to mutually repeat the stop and the rotation of the belt 50.

In Act 8, the main body control circuit 101 acquires the belt temperature from the center thermistor 61 and the edge thermistor 62.

In Act 9, the main body control circuit 101 determines whether or not the belt temperature reaches the target temperature. If it is determined that the belt temperature reaches the target temperature (Yes in Act 9), the main body control circuit 101 proceeds to the processing in Act 10. If it is determined that the belt temperature does not reach the target temperature (No in Act 9), the main body control circuit 101 proceeds to the processing in Act 3.

In Act 10, the main body control circuit 101 starts the rotation of the belt 50 in a state in which the belt temperature reaches the target temperature.

Hereinafter, the operation of the fixing apparatus 34 is described.

As shown in FIG. 2, at the time of warming up the fixing apparatus 34, the fixing apparatus 34 rotates the belt 50 in the arrow u direction. The IH coil unit 52 generates the magnetic flux at the belt 50 side through being applied with the high frequency current by the inverter driving circuit 68.

For example, at the time of the warming-up, in a state in which the belt 50 is separated from the press roller 51, the belt 50 rotates in the arrow u direction. At the time of the warming-up, through rotating the belt 50 in a state in which the belt 50 is separated from the press roller 51, the following effects are achieved. Compared with a case in which the belt 50 rotates in a state in which the belt 50 abuts against the press roller 51, it can be prevented that the heat of the belt 50 is robbed by the press roller 51. Through preventing the heat of the belt 50 from being robbed by the press roller 51, the warming-up time can be shortened.

At the time of the warming-up, in a state in which the press roller 51 abuts against the belt 50, through rotating the press roller 51 in the arrow q direction, the belt 50 may be driven to rotate in the arrow u direction.

As shown in FIG. 3, the IH coil unit 52 heats the belt 50 with the first magnetic circuit 81. The auxiliary heat generation plate 69 assists to heat the belt 50 with the second magnetic circuit 82. Through assisting to heat the belt 50, the rapid warming-up of the belt 50 can be promoted.

As shown in FIG. 2, the IH control circuit 67 controls the inverter driving circuit 68 according to the measurement result of the belt temperature by the center thermistor 61 or the edge thermistor 62. The inverter driving circuit 68 supplies the high frequency current to the main coil 56.

After the temperature of the belt 50 reaches the fixing temperature and the warming-up is terminated, the press roller 51 abuts against the belt 50. In a state in which the press roller 51 abuts against the belt 50, through rotating the press roller 51 in the arrow q direction, the belt 50 is driven to rotate in the arrow u direction. If there is a print request, the MFP 10 (refer to FIG. 1) starts the print operation. The MFP 10 forms the toner image on the sheet P with the printer section 18 and coveys the sheet P to the fixing apparatus 34.

The MFP 10 enables the sheet P on which the toner image is formed to pass through the nip 54 between the belt 50 the temperature of which reaches the fixing temperature and the press roller 51. The fixing apparatus 34 fixes the toner image on the sheet P. In the execution of the fixing operation, the IH control circuit 67 controls the IH coil unit 52 to keep the belt 50 at the fixing temperature.

Through the fixing operation, the heat of the belt 50 is robbed by the sheet P. For example, in a case in which the sheets P are continuously passed at a high speed, as a large amount of the heat of the belt 50 is robbed by the sheets P, there is a case in which the belt 50 cannot be kept at the fixing temperature. The auxiliary heat generation plate 69 assists to heat the belt 50 with the second magnetic circuit 82 to replenish the insufficient belt calorific value. The auxiliary heat generation plate 69 assists to heat the belt 50 with the second magnetic circuit 82 to enable the belt temperature to be maintained at the fixing temperature even at the time of continuously passing the sheets P at a high speed.

Incidentally, in the standby state, the initial value of the frequency applied to the induction current generation section is determined by the target value of the IH output. In a case in which the magnetic material is the magnetic shunt alloy, the IH load changes with the change of the magnetism of the magnetic material. With the change of the IH load, the proper initial value of the frequency also changes. For example, in a case in which the magnetic material is at a normal temperature, the IH output becomes the output with 300 W at the frequency of 98 kHz. On the other hand, in a case in which the temperature of the magnetic material exceeds the Curie point, through reducing the IH load, the IH output becomes the output with 200 W at the frequency of 98 kHz. Even if in a case in which the temperature of the magnetic material exceeds the Curie point, it is possible to variably control the frequency such that the IH output becomes the output with 300 W. However, as delay occurs until the IH output reaches a target value, the belt temperature excessively rises through continuously heating the belt, and there is a possibility that the belt is damaged. Therefore, if the proper initial value of the frequency cannot be set, the IH output is deviated from the target value, and it is difficult to keep the belt temperature constant in the standby state. For example, if the IH output is excessively high, the belt temperature excessively rises in the standby state, and there is a possibility that the belt is damaged. On the other hand, if the IH output is excessively low, the belt temperature cannot sufficiently rises in the standby state, there is a possibility that the belt cannot be kept at a proper standby temperature.

Contrarily, according to the first embodiment, in the standby state, the main body control circuit 101 controls the frequency applied to the IH coil unit 52 based on the belt temperature. There is a correlation among the temperature of the auxiliary heat generation plate 69, the IH output and the frequency applied to the IH coil unit 52. For example, the higher the temperature of the auxiliary heat generation plate 69 is, the lower the IH output becomes. The lower the frequency applied to the IH coil unit 52 is, the higher the IH output becomes. Supposedly, through changing the magnetism of the auxiliary heat generation plate 69, even if the IH load changes, if the belt temperature in the standby state is known, the frequency applied to the IH coil unit 52 can be controlled matching the target value of the IH output. Thus, the belt 50 can be kept at the proper standby temperature.

Further, in the standby state, through stopping the belt 50 by the main body control circuit 101, the following effect is achieved. In the standby state, compared with a case in which the rotation of the belt 50 is continued, as the mileage of the belt 50 can be reduced, the time for the replacement of the fixing apparatus 34 can be extended.

In the standby state, the main body control circuit 101 controls the stop time of the belt 50 to suppress the excessive rise of the belt temperature. Thus, the damage of the belt 50 can be prevented.

In the standby state, through enabling the press roller 51 to separate from the belt 50 by the main body control circuit 101, the following effect is achieved. The creep deformation of the belt 50 generated by continuously pressing the press roller 51 towards the belt 50 can be avoided.

The belt temperature is measured by the center thermistor 61 and the edge thermistor 62. In the present embodiment, as the belt 50 contacts the auxiliary heat generation plate 69, the belt temperature and the temperature of the auxiliary heat generation plate 69 are substantially the same. Thus, through measuring the belt temperature, the temperature of the auxiliary heat generation plate 69 can be indirectly acquired. Further, as the belt temperature can be grasped in real time through measuring the belt temperature, in a case in which the belt 50 reaches the fixing temperature, the fixing operation can be rapidly started.

In a case in which the heat generation layer 50*a* of the belt 50 is made from copper, the following effect can be achieved. Even in a case in which the belt 50 is stopped in the standby state, as the heat can be conveyed in the whole of the belt 50 through the copper of the heat generation layer 50*a*, the occurrence of temperature unevenness in the belt 50 can be suppressed.

Second Embodiment

Next, the second embodiment is described with reference to FIG. 7 and FIG. 8. Further, the same numerals are assigned to forms which are the same as those of the first embodiment, and the description thereof is omitted.

Figure 7:
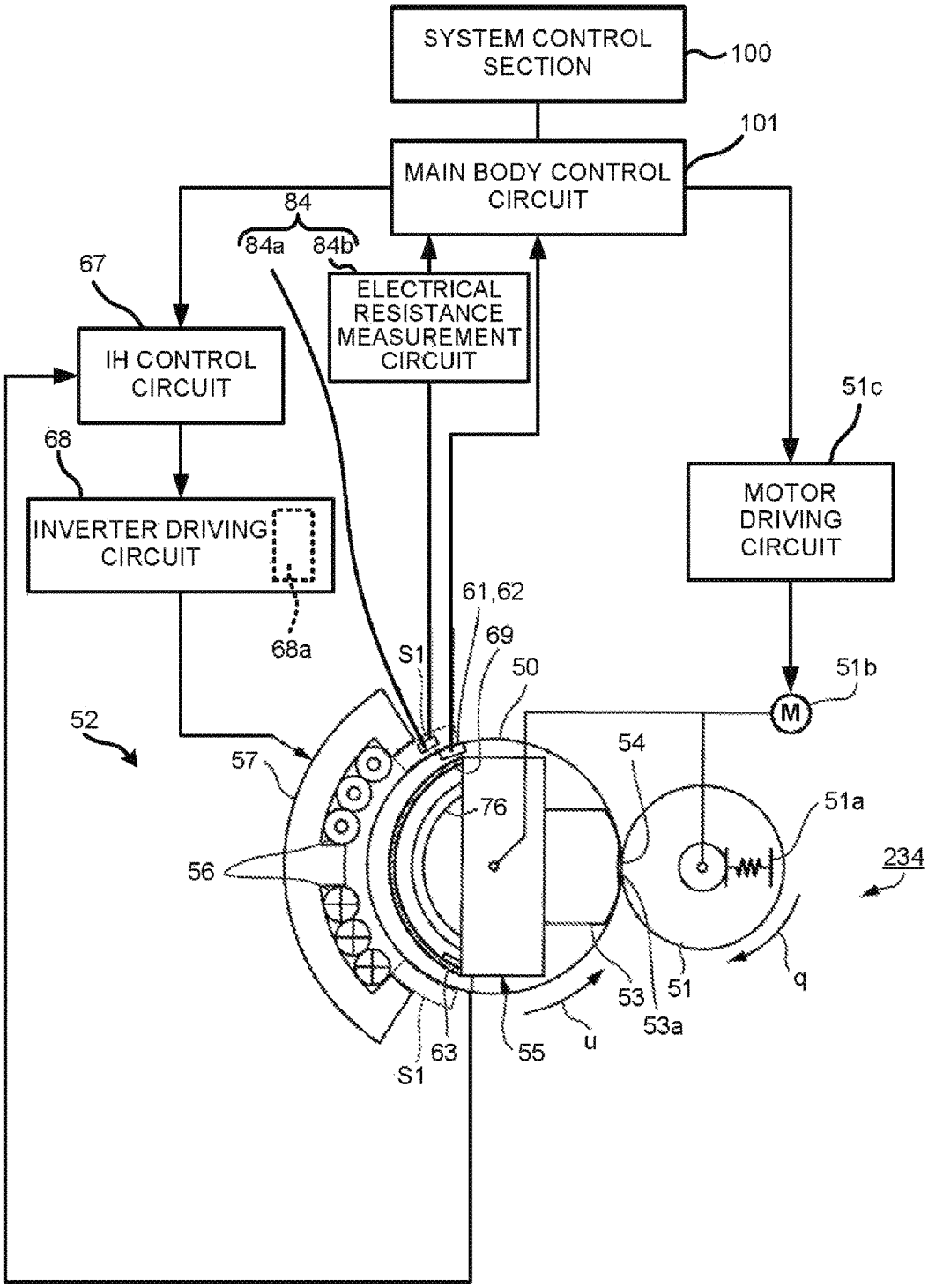
FIG. 7 is a side view containing a control block of an IH coil unit according to a second embodiment.

FIG. 7 is a side view containing the control block of the IH coil unit according to the second embodiment. Further, FIG. 7 is equivalent to the side view of FIG. 2.

As shown in FIG. 7, a fixing apparatus 234 according to the second embodiment is further equipped with a coil unit 84 (measurement section). In the present embodiment, the belt 50 does not contact the auxiliary heat generation plate 69. The two arc-shaped ends of the auxiliary heat generation plate 69 are supported by a foundation (not shown). The radial direction lateral surface of the auxiliary heat generation plate 69 is separated from the inner peripheral surface of the belt 50. For example, the interval between the radial direction lateral surface of the auxiliary heat generation plate 69 and the inner peripheral surface of the belt 50 is about 1 mm-2 mm.

Figure 8:
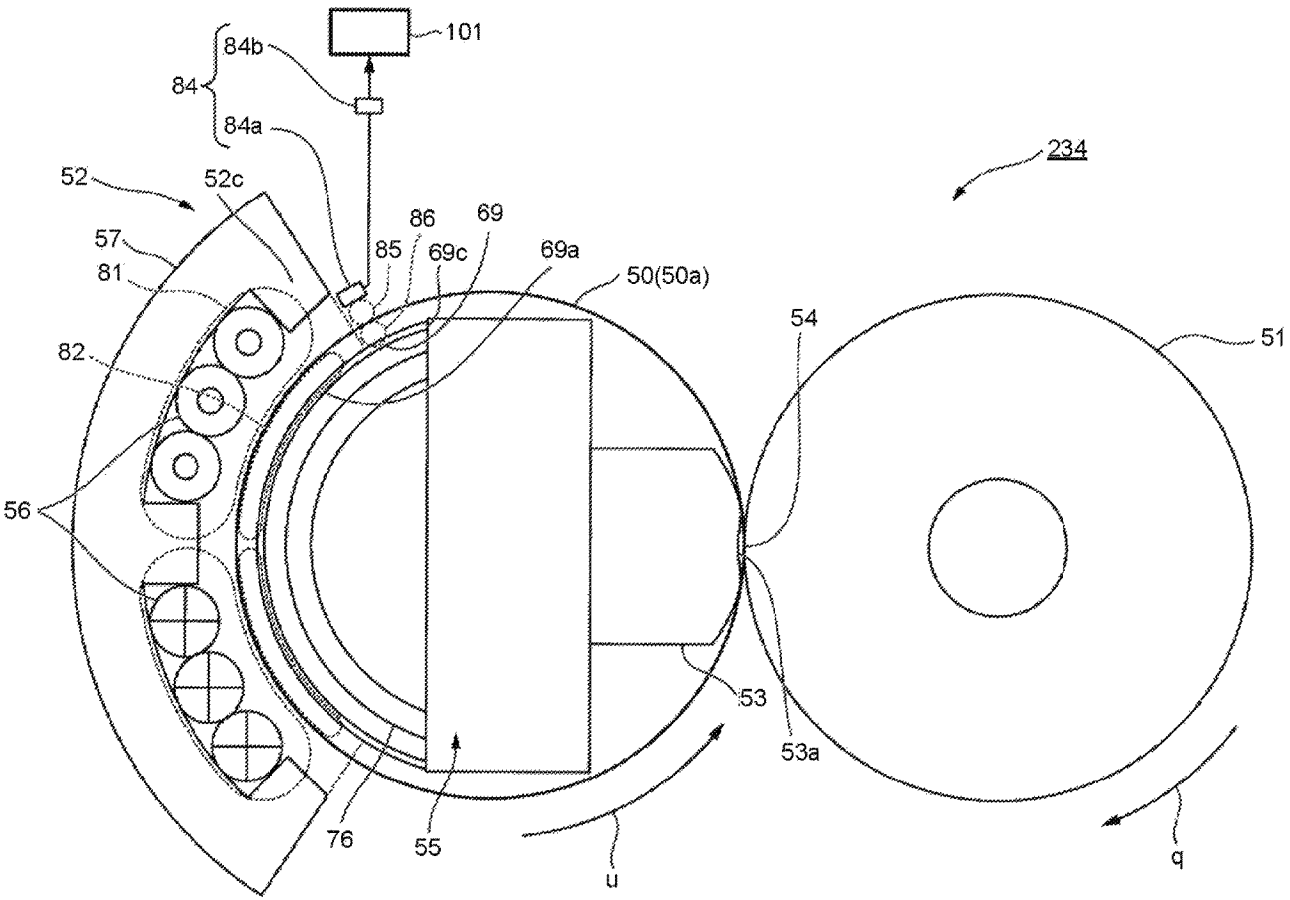
FIG. 8 is a side view illustrating main portions of a fixing apparatus according to the second embodiment.

FIG. 8 is a side view of the main portions of the fixing apparatus 234 according to the second embodiment.

As shown in FIG. 8, the coil unit 84 is equipped with a coil 84*a* and an electrical resistance measurement circuit 84*b* (electrical resistance measurement section). The coil unit 84 measures whether or not the auxiliary heat generation plate 69 is in a state in which the temperature of the auxiliary heat generation plate 69 exceeds the Curie point. The coil 84*a* is configured separately from the main coil 56. The coil 84*a* generates a magnetic field passing through the auxiliary heat generation plate 69 through energization. For example, the coil 84*a* uses winding by the Litz wire. The electrical resistance measurement circuit 84*b* measures the electrical resistance of the coil 84*a*. The measurement result of the electrical resistance of the coil 84*a* is input to the main body control circuit 101.

Hereinafter, in the auxiliary heat generation plate 69, in the circumferential direction (hereinafter, referred to as "belt circumferential direction") of the belt 50, the area facing the IH coil unit 52 across the belt 50 is set to a facing area 69*a*. An end 69*c* of the auxiliary heat generation plate 69, which is an end of the auxiliary heat generation plate 69 in the belt circumferential direction, is an area adjacent to the facing area 69*a*. The end 69*c* of the auxiliary heat generation plate 69 does not face the IH coil unit 52 across the belt 50 in the belt radial direction.

An end 52*c* of the IH coil unit 52, which is an end of the core 57 in the belt circumferential direction, contains the area protruding towards the inner side of the belt radial direction.

The coil 84*a* is arranged in an area S1 (refer to FIG. 7) which faces the auxiliary heat generation plate 69 and does not face the main coil 56. Specifically, the area S1 is located between the end 52*c* of the IH coil unit 52 and the belt 50 in the belt radial direction. The area S1 is a range from the outer side of the main coil 56 to the end 69*c* of the auxiliary heat generation plate 69 in the belt circumferential direction. The area S1 faces the end 52*c* of the IH coil unit 52 and also faces the end 69*c* of the auxiliary heat generation plate 69 across the belt 50 in the belt circumferential direction. One end (inner side end) of the belt circumferential direction in the area S1 faces the boundary between the end 52*c* of the IH coil unit 52 and the main coil 56 in the belt radial direction. The other end (outer side end) of the belt width direction in the area S1 faces front ends (two ends) of the end 69*c* of the auxiliary heat generation plate 69 across the belt 50 in the belt radial direction.

In the present embodiment, the coil 84*a* is arranged at the outer peripheral side of the belt 50. The coil 84*a* faces the end 69*c* of the auxiliary heat generation plate 69 across the belt 50.

The coil 84*a*, in a range of not facing the main coil 56, may face the facing area 69*a* of the auxiliary heat generation plate 69 across the belt 50.

The coil 84*a* is separated from the belt 50 at a predetermined interval to be fixed. The coil 84*a* faces at least the sheet passing area in the belt width direction. For example, the coil 84*a* faces the center part of the belt 50.

The size of the coil 84*a* is smaller than that of the main coil 56. In this way, the coil 84*a* generates the magnetic field passing through the auxiliary heat generation plate 69 through the energization and the electrical resistance measurement circuit 84*b* can measure the electrical resistance of the coil 84*a*.

Compared with a case in which the size of the coil 84*a* is equal to or larger than that of the main coil 56, the coil 84*a* is easily arranged in the area S1.

The magnetic flux generated by the coil 84*a* forms a third magnetic circuit 85 induced to the heat generation layer 50*a* of the belt 50. The third magnetic circuit 85 passes through the heat generation layer 50*a*. The magnetic flux generated by the coil 84*a* forms a fourth magnetic circuit 86 induced to the auxiliary heat generation plate 69 before the temperature of the auxiliary heat generation plate 69 exceeds the Curie point and the auxiliary heat generation plate 69 loses the magnetism. The fourth magnetic circuit 86 is formed at a position adjacent to the third magnetic circuit 85 in the belt radial direction. The fourth magnetic circuit 86 passes through the auxiliary heat generation plate 69 and the heat generation layer 50*a*. The electrical resistance of the coil 84*a* changes along with the change of the magnetism of the auxiliary heat generation plate 69. That is, the electrical resistance of the coil 84*a* changes depending on whether or not the fourth magnetic circuit 86 is formed.

Through enabling a weak high frequency current (hereinafter, referred to as "high frequency weak current") to flow in the coil 84*a*, the electrical resistance of the coil 84*a* can be measured. For example, the electrical resistance measurement circuit 84*b* is connected with an upstream side and a downstream side of the coil 84*a* to measure the electrical resistance from the current values in the upstream side and the downstream side of the coil 84*a*. For example, the high frequency weak current is set to a current of 10 mA with a frequency of 60 kHz. The high frequency weak current is set to a current which is weaker than the high frequency current output by the inverter driving circuit 68.

In the present embodiment, in the standby state, the main body control circuit 101 controls the frequency applied to the IH coil unit 52 based on the electrical resistance to enable the IH output to approach to the target value.

According to the second embodiment, the same effect as the first embodiment can be achieved. Specifically, there is a correlation among the electrical resistance, the IH output and the frequency applied to the IH coil unit 52. For example, the lower the electrical resistance is (lower than a threshold value), through reducing the IH load by enabling the temperature of the auxiliary heat generation plate 69 to exceed the Curie point thereof, the lower the IH output becomes. Supposedly, through changing the magnetism of the auxiliary heat generation plate 69, even if the IH load changes, if the electrical resistance in the standby state is known, the frequency applied to the IH coil unit 52 can be controlled matching the target value of the IH output. Thus, the belt 50 can be kept at the proper standby temperature.

Further, through measuring the electrical resistance, as the change of the magnetism of the auxiliary heat generation plate 69 can be grasped in real time, it is easy to keep the belt 50 at the proper standby temperature.

As the coil 84*a* is configured separately from the main coil 56, the electrical resistance measurement circuit 84*b* can frequently measure the electrical resistance of the coil 84*a*.

Through arranging the coil 84*a* in the area S1 which faces the auxiliary heat generation plate 69 and does not face the main coil 56, the following effect can be achieved. Compared with a case of arranging the coil 84*a* in an area that faces the main coil 56, as the influence of large magnetic force of the main coil 56 on the coil 84*a* can be suppressed, the electrical resistance of the coil 84*a* can be measured with high accuracy.

By enabling the coil 84*a* to face the end 69*c* (a part adjacent to the facing area 69*a*) of the auxiliary heat generation plate 69 across the belt 50, the following effect can be achieved. The coil unit 84 can measure the electrical resistance of the coil 84*a* at a position (a position which correlates with the temperature change of the facing area 69*a*) which has the equal temperature change with the facing area 69*a*.

By enabling the coil 84*a* to face at least the sheet passing area in the belt width direction, the coil unit 84 can measure the electrical resistance of the coil 84*a* by classifying the sheet non-passing area.

According to the fixing apparatus of at least one embodiment described above, the belt 50 can be kept at the proper standby temperature.

The foregoing heat generation layer 50*a* may be formed by the magnetic material such as nickel.

Further, the measurement section may include a temperature measurement section for measuring the temperature of the auxiliary heat generation plate 69. For example, the temperature measurement section uses a temperature sensor. Through measuring the temperature of the auxiliary heat generation plate 69, whether or not the temperature of the auxiliary heat generation plate 69 exceeds the Curie point can be directly determined. In other words, the measurement section may be optional as long as it can measure the state of the auxiliary heat generation plate 69.

In the standby state, the main body control circuit 101 may control the frequency applied to the IH coil unit 52 based on the measurement result of the temperature sensor. In other words, in the standby state, the measurement section may be optional as long as the main body control circuit 101 controls the frequency applied to the IH coil unit 52 based on the measurement result of the measurement section.

In the standby state, the main body control circuit 101 may control the heating time spent in heating the belt 50. For example, the main body control circuit 101 may determine whether or not the belt temperature or the temperature of the magnetic shunt alloy exceeds a threshold value. If it is determined that the belt temperature or the temperature of the magnetic shunt alloy exceeds the threshold value, the main body control circuit 101 carries out the control to stop the heating of the belt 50. If it is determined that the belt temperature or the temperature of the magnetic shunt alloy is smaller than a threshold value, the main body control circuit 101 carries out the control to continue the heating of the belt 50.

Further, the coil 84*a* may be arranged at the inner side of the radial direction of the auxiliary heat generation plate 69 in the inner peripheral side of the belt 50. Compared with a case in which the coil 84*a* is arranged at the outer peripheral side of the belt 50, the coil 84*a* can be aggregated at the inner peripheral side of the belt 50 together with the auxiliary heat generation plate 69.

The fixing apparatus 234 may not include the coil 84*a* but include a measurement section using the main coil 56. Compared with a case in which the coil 84*a* faces the end 69*c* of the auxiliary heat generation plate 69 across the belt 50, the electrical resistance of the main coil 56 at a position adjacent to the facing area 69*a* can be measured. Thus, the change of the magnetism of the facing area 69*a* can be determined. Compared with a case in which the coil 84*a* is configured separately from the main coil 56, the number of the components can be reduced, and thus the constitution of the fixing apparatus 234 can be simplified.

The functions of the fixing apparatus according to the foregoing embodiments may be realized by a computer. In this case, programs for realizing the functions are recorded in a computer-readable recording medium and the programs recorded in the computer-readable recording medium may be read into a computer system and executed to be realized. Further, it is assumed that the "computer system" described herein contains an operating system or hardware such as peripheral devices. Further, the "computer-readable recording medium" refers to a portable medium such as a flexible disc, a magneto-optical disk, a ROM, a CD-ROM and the like or a storage device such as a hard disk built in the computer system. Furthermore, the "computer-readable recording medium" refers to a medium for dynamically holding the programs for a short time like a communication wire in a case in which the programs are sent via a communication line such as a network like the Internet or a telephone line. The "computer-readable recording medium" may hold the programs for a certain time like a volatile memory in the computer system serving as a server and a client. The foregoing programs may realize a part of the above-mentioned functions. Further, the foregoing program may be realized by the combination of the above-mentioned functions with the programs already recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing apparatus, comprising:

a belt comprising a conductive layer;

an induction current generator that faces the belt and heats the conductive layer through an electromagnetic induction system;

a magnetic material that faces the induction current generator across the belt;

a measurement section that measures a state of the magnetic material; and a controller that controls a frequency applied to the induction current generator based on a measurement result of the measurement section in a standby state in which the fixing apparatus does not execute a fixing operation, the standby state being equivalent to a state in which a MFP does not receive a print request, wherein in the standby state, the controller stops a rotation of the belt, thereafter, acquires a temperature of the belt, thereafter, refers to a table, thereafter, determines a frequency applied to the induction current generator based on the temperature of the belt, thereafter, sets the determined frequency as the frequency applied to the induction current generator.

2. The fixing apparatus according to claim 1, further comprising a driver that rotates the belt, wherein the controller controls the driver to rotate or stop the belt in the standby state.

3. The fixing apparatus according to claim 1, further comprising a press roller that is positioned at the outer peripheral side of the belt, wherein the controller separates the press roller from the belt in the standby state.

4. The fixing apparatus according to claim 1, wherein the measurement section comprises a temperature measurement section that measures a temperature of at least one of the magnetic material and the belt.

5. The fixing apparatus according to claim 1, wherein the measurement section comprises: a coil that generates a magnetic field passing through the magnetic material; and an electrical resistance measurement section that measures the electrical resistance of the coil.

6. The fixing apparatus according to claim 1, wherein the conductive layer comprises a nonmagnetic metal.

7. The fixing apparatus according to claim 1, wherein the conductive layer comprises one of the group consisting of copper, stainless steel, aluminum, silver, nickel, and alloys thereof.

8. The fixing apparatus according to claim 1, wherein the controller carries out an IH control in such a manner that the lower the temperature of the magnetic material is, the higher the frequency applied to the induction current generator becomes.

9. The fixing apparatus according to claim 1, wherein the controller carries out an IH control in such a manner that the higher the temperature of the magnetic material is, the lower the frequency applied to the induction current generator becomes.

10. The fixing apparatus according to claim 1, wherein in the standby state, the controller separates a press roller from the belt, thereafter, stops a rotation of the belt, thereafter, acquires a temperature of the belt, thereafter, refers to a table, thereafter, determines a frequency applied to the induction current generator based on the temperature of the belt, thereafter, sets the determined frequency as the frequency applied to the induction current generator, thereafter, applies the set frequency to the induction current generator to heat the belt, thereafter, acquires the temperature of the belt, thereafter, determines whether or not the belt temperature reaches a target temperature, thereafter, and starts the rotation of the belt in a state in which the temperature of the belt reaches the target temperature.

11. The fixing apparatus according to claim 1, wherein after the controller sets the determined frequency, in the standby state, the controller applies the set frequency to the induction current generator to heat the belt and controls a stop time of the belt.

12. The fixing apparatus according to claim 11, wherein in the standby state, the controller carries out the control so as to mutually repeat the stop and the rotation of the belt.

13. A fixing apparatus, comprising:

a belt comprising a conductive layer;

an induction current generator that faces the belt and heats the conductive layer through an electromagnetic induction system;

a magnetic material that faces the induction current generator across the belt;

a measurement section that measures a state of the magnetic material; and a controller that controls a frequency applied to the induction current generator based on a measurement result of the measurement section in a standby state in which the fixing apparatus does not execute a fixing operation, the standby state being equivalent to a state in which a MFP does not receive a print request, wherein the controller carries out an IH control in such a manner that the lower the temperature of the magnetic material is, the higher the frequency applied to the induction current generator becomes.

14. A fixing apparatus, comprising:

a belt comprising a conductive layer;

an induction current generator that faces the belt and heats the conductive layer through an electromagnetic induction system;

a magnetic material that faces the induction current generator across the belt;

a measurement section that measures a state of the magnetic material; and a controller that controls a frequency applied to the induction current generator based on a measurement result of the measurement section in a standby state in which the fixing apparatus does not execute a fixing operation, the standby state being equivalent to a state in which a MFP does not receive a print request, wherein the controller carries out an IH control in such a manner that the higher the temperature of the magnetic material is, the lower the frequency applied to the induction current generator becomes.

* * * * *